United States Patent [19]

Takahashi

[11] Patent Number: 4,792,780

[45] Date of Patent: Dec. 20, 1988

[54] SLIDING OPERATION TYPE ELECTRIC PART

[75] Inventor: Kisaburo Takahashi, Miyagi, Japan

[73] Assignee: Alps Electric Co., Ltd., Japan

[21] Appl. No.: 79,690

[22] Filed: Jul. 30, 1987

[30] Foreign Application Priority Data

Sep. 10, 1986 [JP] Japan ..... 61-137944[U]
Sep. 10, 1986 [JP] Japan ..... 61-137945[U]

[51] Int. Cl.[4] ..... H01C 1/12
[52] U.S. Cl. ..... 338/202; 338/176; 338/182
[58] Field of Search ..... 338/176, 177, 178, 182, 338/183, 202

[56] References Cited

U.S. PATENT DOCUMENTS 3,550,059 12/1970 Barden et al. ..... 338/176

*Primary Examiner*—E. A. Goldberg
*Assistant Examiner*—M. M. Lateef
*Attorney, Agent, or Firm*—Guy W. Shoup; Paul J. Winters

[57] ABSTRACT

A sliding operation type electric part comprising a first slider holder, to the upper surface of which a slider is secured by burying a part thereof so that it extends on the surface thereof, and a second slider holder, to the lower surface of which a slider is secured by burying a part thereof so that it extends on the surface thereof, is disclosed, in which the first and the second slider holder are united in one body through linking means and the sliders are so disposed that they are slidingly in contact with conductive patterns.

3 Claims, 4 Drawing Sheets

SLIDING OPERATION TYPE ELECTRIC PART

FIELD OF THE INVENTION

This invention relates to a sliding operation type electric part such as a sliding type variable resistance, sliding type switch, etc. and in particular to a sliding operation type electric part, in which a slider is disposed on each of the upper and lower surfaces of a slider holder.

BACKGROUND OF THE INVENTION

As a sliding operation type electric part, heretofore there is known a part, in which a plurality of electric controls are effected by displacing an operation level. For example, a lightening type sliding variable resistance is a part, in which the value of a resistance and the on and off of light emitting diodes are controlled by displacement of one operation lever and which is used for graphic equalizer.

Such a prior art lightening type sliding variable resistance is generally so constructed that a resistor and a collector for the variable resistance and a collector for the light switch are disposed in parallel on a base plate and sliders sliding on conductive patterns are disposed on the lower surface of a slider holder, whereby the contact position of the slider with each of the conductive patterns is varied by operating an operation lever projectingly disposed on the upper surface of this slider holder.

However such a prior art lightening type sliding variable resistance has drawbacks that, since the conductive patterns and the sliders, which are slidingly in contact therewith, are disposed in parallel, it is large in the width and that in the field of the control of parts, since the form of the slider is complicated, they are easily deformed at the mounting, the transportation, etc.

In order to remove these drawbacks, a new lightening type sliding variable resistance has been proposed, as disclosed in JP-Utility Model-A-59-195701, in which a plurality of conductive patterns are disposed, divided into two groups, one on a base plate and the other in a case located thereon, at the same time, corresponding to these conductive patterns, the slider, which is slidingly in contact with the collector for the light switch, is disposed on the upper surface of the slider holder and the slider, which is slidingly in contact with the resistor and the collector for the variable resistance, is disposed on the lower surface of the slider holder.

According to the prior utility model application stated above disclosing the sliding operation type electric part, since a plurality of conductive patterns are divided into two groups, upper and lower, it is possible to make it smaller and in particular to make the size in the direction of the width considerably smaller. However, since it is necessary to dispose the sliders, which are slidingly in contact with the conductive patterns, on both the upper and lower surfaces of the slider holder, it is very difficult because of the structure of the metal mold to adopt a method for forming sliders and a slider holder in one body, which has been developed for the purpose of increasing the productivity, i.e. a method, by which the slide holder is formed by insert in the sliders to unite them in one body. For this reason it was inevitable to adopt a structure, in which pins disposed projectingly on the slider holder are inserted in holes formed in the sliders and they are fixed to each other by calking.

This structure has drawbacks in productivity and in work efficiency.

OBJECT OF THE INVENTION

Accordingly the object of this invention is to provide a sliding operation type electric part which resolves problems of the prior art techniques described above, and to fabricate the slider holder, on both the upper and lower surfaces on which sliders are disposed, by the insert fabrication method, which is suitable for reducing the size.

SUMMARY OF THE INVENTION

In order to achieve the above object, this invention is characterized in that in a sliding operation type electric part, in which sliders are mounted on a slider holder capable of being moved freely forward and backward and the sliders are constructed so as to be slidingly in contact with conductive patterns, the slider holder consists of a first slider holder, to the upper surface of which a slider is secured by burying a part thereof so that it extends on the surface thereof, and a second slider holder, to the lower surface of which a slider is secured by burying a part thereof so that it extends on the surface thereof, these first and second slider holders being united in one body through linking means.

When the slider holder is constituted by the first and second slider holders, the sliders can be formed on the respective slider holders in one body by the insert fabrication method. When these slider holders are jointed so as to be one body e.g. by inserting pins in respective holes, it is possible to form a slider holder, on both the upper and lower surfaces of which sliders are disposed, respectively.

DETAILED DESCRIPTION

Figure 1:
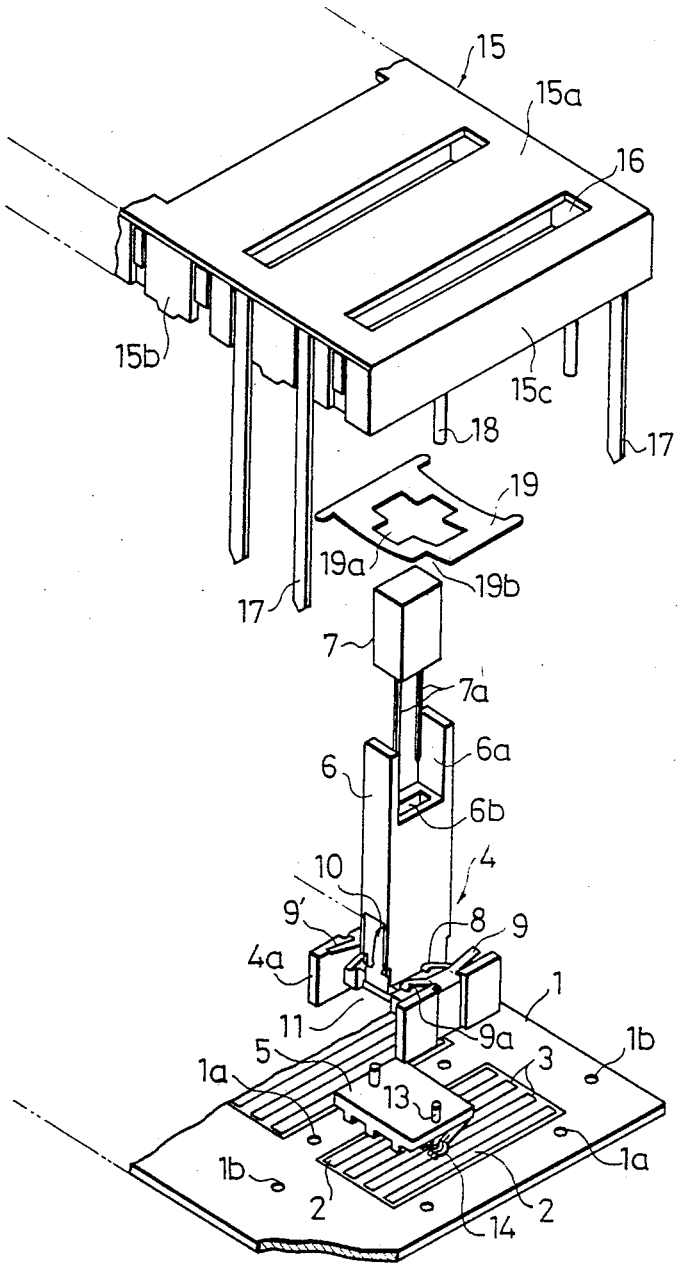
FIG. 1 is an exploded perspective view of principal parts of a lightening type sliding variable resistance, which is an embodiment of this invention.

Hereinbelow an embodiment of this invention will be explained in detail, referring to the drawings.

Figure 2:
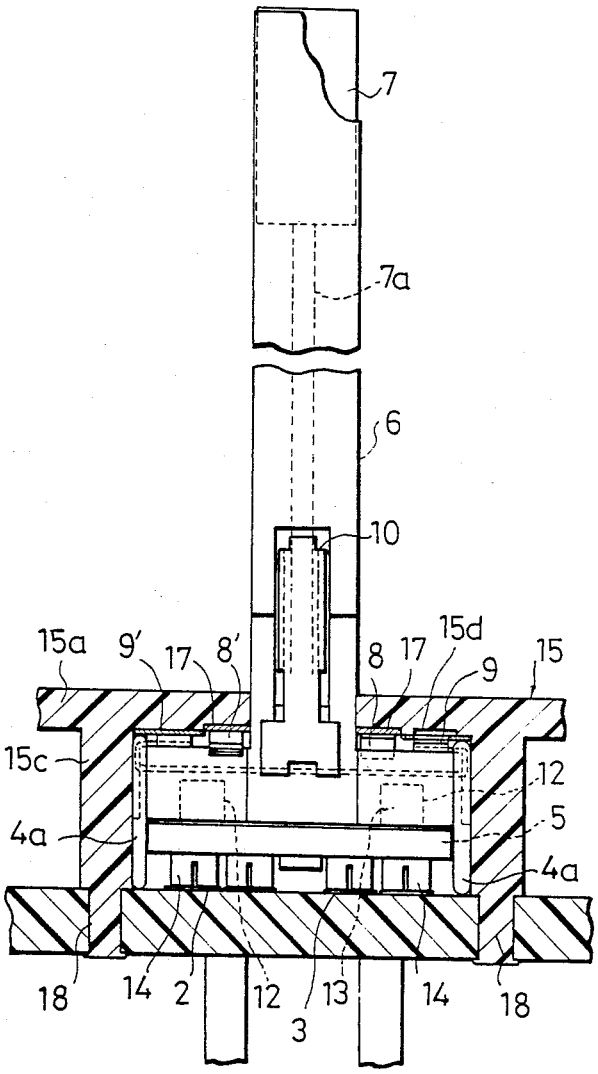
FIG. 2 is a cross-sectional view of the mounted lightening type sliding variable resistance.
Figure 3:
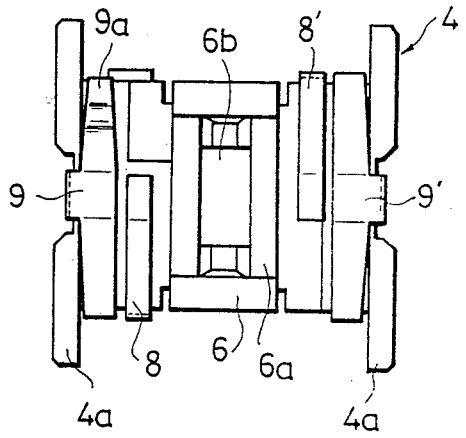
FIG. 3 is a plan view of the first slider holder.

FIG. 1 is an exploded perspective view of principal parts of a lightening type sliding variable resistance; FIG. 2 is a cross-sectional view illustrating partially the principal parts thereof in their mounted state; and FIG. 3 is a plan view of the first slider holder disposed in the lightening type sliding variable resistance.

In these figures reference numeral 1 represents a base plate made of an insulating material, on the upper surface of which two resistors 2 and two collectors, i.e. in total four conductive patterns are disposed for every sliding type variable resistance. In addition, around these conductive patterns are formed a plurality of stopping holes 1*a* and throughholes 1*b*. 4 and 5 indicate a first and a second slider holder, respectively, both being made of synthetic resin. These slider holders are linked in one body through linking means described later so as to form one slider holder.

An operation knob 6 is projectingly formed in one body with the first slider holder 4 stated above. At the top of the operation knob 6 is formed a recess 6a, in which the principal portion of a light emitting diode 7 is inserted and positioned, and in the interior of the operation knob 6 is formed a connecting hole 6b connected with the recess 6a. Further, on this first slider holder 4 are formed first sliders 8, 8', plate springs 9, 9' and lead conductors 10, 10' in pair, respectively, by the insert formation method so that they protrude upward. The first slider 8, the plate spring 9 and the lead conductor 10, constituting one of the two sets, are connected with each other within the slider holder 4 so that they are in an electrically conductive state. In the same way the first slider 8', the plate spring 9' and the lead conductor 10', constituting the other of the two sets, are connected with each other within the slider holder 4 so that they are in an electrically conductive state, these two sets being insulated from each other. As clearly seen from FIG. 3, the plate springs 9 and 9' are located at the two side edges of the slider holder 4 and the first sliders 8 and 8' are positioned on the inner sides thereof, respectively, so that they are not superposed on each other. Further, as clearly seen from FIG. 2, both the lead conductors 10 and 10' are bent upward and extend to the interior of the connecting hole 6b within the operation knob 6. In this way, when the light emitting diode 7 is mounted on the operation knob 6, the terminals 7a of the light emitting diode 7 are elastically brought into contact with the lead conductors 10 and 10', respectively, and held within the connecting hole 6b so as to prevent slipping out of the light emitting diode 7 and to connect them electrically.

In addition, supporting walls 4a, which are opposite to each other, are formed in one body with the first slider holder 4 at its two side surfaces. The inner surfaces of these supporting walls 4a and the lower surface of the slider holder 4 form a space 11, into which the second slider holder 5 can be inserted. In the ceiling plate of this space 11, i.e. the lower surface of the first slider holder 4 are formed stopping holes 12 (refer to FIG. 2).

On the other hand, on the upper surface of the second slider holder 5 are projectingly disposed pins 13, corresponding to the stopping holes 12 stated above, so as to be able to be inserted thereinto. Further, on its side surfaces are formed a pair of second sliders 14 by the insert formation method so as to extend downward.

Reference numeral 15 is a frame made of a synthetic resin, consisting of a ceiling portion 15a, side walls 15b and partition walls 15c. In the ceiling portion 15a are formed a plurality of rectangular guiding slits 16 with a predetermined interval. On this frame 15 are formed a plurality of lead plates 17 made of metallic thin plate by the insert formation method. For every guiding slit 16 two lead plates 17 are disposed on the lower surface of the ceiling portion 15a so as to extend parallelly and downward along the side walls 15b so that they can pass through the throughholes 1b formed in the base plate 1 described previously. At predetermined positions on the lower surface of the ceiling portion 15a are formed depressions for click 15d, which are capable to be enaged with and disengaged from protrusions for click described later. In addition, on the lower surface of each of the partition walls 15c is disposed a connecting pin 18, hanging downward. The connecting pin 18 is so formed that it can be inserted into a stopping hole 1a formed in the base plate 1 described previously. Reference numeral 19 is a friction plate. At the center of this friction plate 19 is formed a cross-shaped cut off opening 19a permitting the insertion of the operation knob 6 and at the same time the exposure of both the first sliders 8 and 8'. At one corner thereof is formed a cut off portion 19b for the exposure of the protrusion for click 9a formed on one of the plate springs 9.

Now mounting work of the lightening type sliding variable resistance thus constructed will be explained below, referring mainly to FIG. 2.

At first a first slider holder 4 and a second slider holder 5 fabricated in a separate fabrication step are prepared. They are united in one body by inserting the pin 13 on the second slider holder 5 into the stopping hole 12 on the first slider holder 4. Both of these first and second slider holders 4 and 5 can be fabricated by the insert formation method excellent in productivity and the fabrication step thereof will be described later.

At the same time as the work stated above a light emitting diode 7 is inserted into the operation knob 6 and held therein. The terminals 7a of the light emitting diode 7 are brought into contact with the lead conductors 10 and 10'. At the same time, the operation knob 6 is inserted into the cut off opening 19a formed in the friction plate 19 and held there.

Next, each of the slider holders is inserted into the frame 15 from under so that the operation knob 6 passes through a guiding hole 16, protruding upward. Subsequently the frame 15 is placed on the base plate 1 and fixed thereto by soldering the pins 18 protruding on the lower surface of the base plate 15, after having inserted the lead conductors 17 and the connecting pins of the frame 15 into the throughholes 1b and the stopping holes 1a, respectively, formed in the base plate 1.

In this state the second sliders 14 extending along the lower surface of the second slider holder 5 are in contact with a resistor 2 and a collector 3, respectively, formed on the base plate 1. Further, the first sliders 8 and 8' extending along the upper surface of the first slider holder 4 are in contact with the lead conductors 17, respectively, disposed on the lower surface of the ceiling portion 15a through the cut off opening 19a in the friction plate 19. In addition, both the plate springs 9 and 9' are brought elastically into contact with the lower surface of the ceiling portion 15a through the friction plate 19 and the slider holders 4 and 5 united in one body are thrusted by its reaction force against the base plate 1.

Now, when the operation knob 6 is slidingly operated by fingers, since the second sliders 14 are slided on the resistor 2 and the collector 3 disposed on the base plate 1, linked with the operation knob 6, the resistance is varied to an arbitrary value. Further, during this slide operation, since the light emitting diode 7 is connected electrically with the lead plates 17, with which the sliders 8 and 8' are slidingly in contact, through the lead conductors 10 and 10' connected with the two terminal 7a, respectively, and the first sliders 8 and 8' connected electrically within the second slider holder 4, the lead conductors 17 are fed with electric power and thus light is emitted in the recess 6a on the operation knob 6. Further, during this sliding operation, the protrusion for click 9a formed on one of the plate springs 9 enters the depression for click 15d formed at a predetermined position on the lower surface of the ceiling portion 15a so that click feeling (node feeling) can be obtained at the position.

Next, the fabrication steps of the first and the second slider holder 4 and 5 will be explained below.

Figure 4:
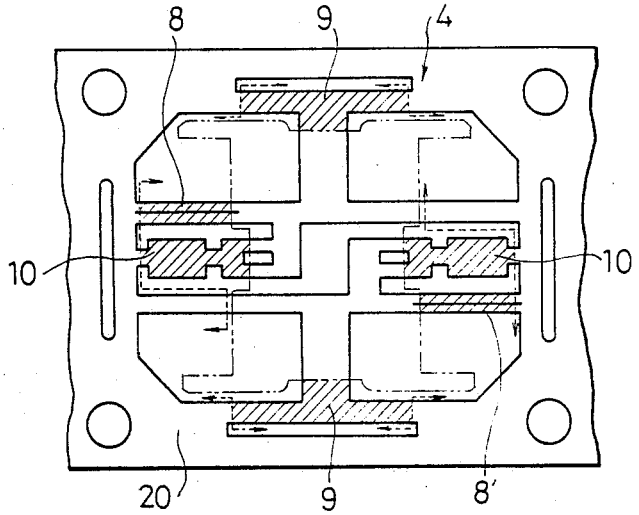
FIG. 4 is a plan view of a hoop element for explaining the fabrication steps of the first slider holder.

At first, a hoop element 20 made of elastic material is prepared, which is punched in the form indicated by the full line in FIG. 4. After that, the hoop element 20 is sent to a metal mold not indicated in the figure. The portion indicated by the two-dot-one-dashed line in the figure is filled with molten resin. This two-dot-one-dahed line indicates the contour of the first slider holder 4 described above. When the hoop element 20 is cut at the position of the broken line in FIG. 4 after having been thus formed by the insert formation method, the first slider holder 4 and the portion hatched in the figure are cut off from the hoop element 20. After that, when the is hatched portion is bent in a predetermined manner (refer to FIG. 1 or 3), a first slider holder 4 is obtained, with which the first sliders 8 and 8', the plate spring 9 and 9' and the lead conductors 10 and 10' are formed in one body.

Figure 5:
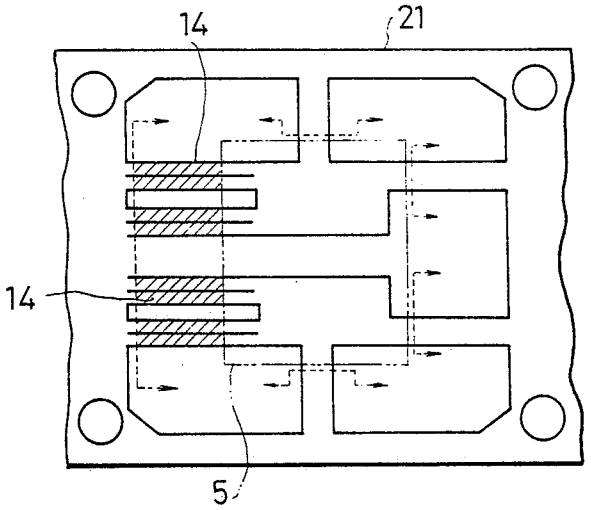
FIG. 5 is a plan view of a hoop element for explaining the fabrication steps of the second slider holder.

Similarly a hoop element 21 made of an elastic material is punched in the form indicated by the full line in FIG. 5, which is sent to a metal mode not indicated in the figure. When the portion indicated by the two-dot-one-dahed line in the figure is filled with molten resin, a second slider holder 5 is formed at that portion. After that, when the hoop element 21 is cut at the position indicated by the broken line in the figure and the hatched portion is bent in the predetermined manner, by using this portion is formed a second slider 14 and a second slider holder 5 is obtained.

This embodiment is constructed as explained above and since the light emitting diode 7 is fed with electric power through the lead conductors 17 disposed on the lower surface of the ceiling portion 15*a* of the frame 15 and the first slider 8 and 8' disposed on the upper surface of the slider holder, the size of the base plate 1 and the slider holders 4 and 5, and in particular the size in the direction of their width can be made considerably smaller.

In addition,since the plate springs 9 and 9' giving the slider holders 4 and 5 resilient force towards the base plate 1 are held by burying a part thereof in the f first slider holder 4, it is not necessary to dispose any special means on the plate springs 9 and 9' and the first slider holder 4 for positioning them (e.g. holes and pins). Also for this reason the device according to this invention is suitable for making the size smaller. Beside it, since the plate springs 9 and 9' are connected with the first sliders 8 and 8' and the lead conductors 10 and 10', respectively, these can be fabricated starting from one hoop element and at the same time these function as a holder for the hoop element at the mould formation, which can increase the productivity.

Further, since the first slider holder 4, on the upper surface of which the first sliders 8 and 8' are disposed, and the second slider holder 5, on the lower surface of which the second sliders 14 are disposed, are fabricated in a separate step by the insert fabrication method and united in one body thereafter, it is possible to fabricate slider holders having sliders at both the upper and lower sides by the insert fabrication method, which is excellent in the productivity.

Although, in the above embodiment, explanation has been made for the case where the pin 13 disposed on the second slider holder 5 is inserted in the stopping hole 13 formed in the first slider holder 4 in order to unite them in one body, this relation can be reversed. That is, the pin may be disposed projectingly on the lower surface of the first slider holder 4 and a hole may be formed in the upper surface of the second slider holder 5. It is also possible to unite them in one body by using other jointing means, e.g. a dovetail joint.

As explained above, according to this invention, since the first and second slider holders fabricated separately are united in one body by means of connecting means, it is possible to fabricate slider holders by the insert fabrication method, which is excellent in the productivity, and at the same time the spaces on the upper and lower sides of the slider holder can be utilized with a high efficiency. Consequently it is possible to make the sliding operation type electric part and in particular the size in the direction of its width smaller.

Furthermore, according to this invention, since the plate springs thrusting the slider holders towards the base plate are formed in one body with the relevant slider holder by burying a part of them in the slider holder, an advantage can be obtained that it si possible to position the plate springs on the upper surface of the slider holder at the insert formation of the slider holder and to hold it there and thus the mounting work can be simplified.

The embodiments of the invention in which an exclusive property or privilege is claimed are defined as follows:

1. A sliding operation type electric part comprising:

a horizontal base plate made of insulating material and have conductive patterns formed on an upper surface thereof;

a frame made of an insulating material mounted on said base plate having a horizontal upper wall provided with a lower surface thereof spaced vertically from the upper surface of said base plate, said frame having a plurality of slits formed through said upper wall which are in parallel and spaced laterally apart from each other;

a plurality of slider holders slidably mounted in the space between said upper wall of said frame and said base plate having respective operation knobs with illuminated ends which project through said slits to an upper side of said frame so that said knobs can be operated to move the respective slider holders longitudinally on the respective conductive patterns formed on the upper surface of said base plate, wherein said frame includes, for each of said slits, a pair of conductive plates provided on said lower surface of said upper wall, each of said conductive plates extending longitudinally on a respective side of said slit, and wherein each of said slider holders includes a first slider holder to which said knob is mounted, a light emitting member mounted on the illuminated end of said knob having a pair of terminals extending downward through said knob toward said first slider holder, a pair of first sliders mounted on an upper side of said first slider holder and extending in electrical contact slidably with the pair of conductive plates, respectively, connecting portions buried in said knob connecting said first sliders to said terminals of said light emitting member, respectively, a second slider holder mounted on a lower side of said first slider holder, a second slider carried on said second slider holder and extending on a lower side thereof in electrical contact slidably with a respective conductive pattern on said base plate, and linking means for physically uniting said first and second slider holders in one body.

2. A sliding operation type electric part according to claim 1, wherein said linking means is formed by inserting a pin disposed in a lower surface of said first slider holder or an upper surface of said second slider holder into a hole formed in the other.

3. A sliding operation type electric part according to claim 1, wherein said first slider holder is made of synthetic resin, a part of a plate spring disposed between the upper surface of said first slider holder and the lower surface of said second slider holder is buried in said first slider holder.

* * * * *